US011661293B2

(12) United States Patent
Murayama et al.

(10) Patent No.: US 11,661,293 B2
(45) Date of Patent: May 30, 2023

(54) SHEET STORAGE APPARATUS AND IMAGE FORMING APPARATUS

(71) Applicant: CANON KABUSHIKI KAISHA, Tokyo (JP)

(72) Inventors: Shigeo Murayama, Shizuoka (JP); Akira Matsushima, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/465,091

(22) Filed: Sep. 2, 2021

(65) Prior Publication Data

US 2022/0089390 A1 Mar. 24, 2022

(30) Foreign Application Priority Data

Sep. 18, 2020 (JP) ..... JP2020-157201

(51) Int. Cl.
*B65H 9/04* (2006.01)
*B65H 1/26* (2006.01)

(52) U.S. Cl.
CPC ..... *B65H 1/266* (2013.01); *B65H 9/04* (2013.01); *B65H 2402/32* (2013.01); *B65H 2402/80* (2013.01)

(58) Field of Classification Search
CPC ..... B65H 1/266; B65H 9/04; B65H 2402/32; B65H 2402/60; B65H 2402/80; B65H 2403/411; B65H 2511/10; B65H 2511/20; B41J 29/02; B41J 29/13; G03G 15/6502
See application file for complete search history.

(56) References Cited

U.S. PATENT DOCUMENTS 8,475,065 B2 * 7/2013 Kokawa ..... B41J 3/4075 400/613
8,500,117 B2 * 8/2013 Uchida ..... B65H 1/266 271/127
8,684,351 B2 * 4/2014 Akimatsu ..... B65H 1/04 271/171
9,840,382 B2 * 12/2017 Okazaki ..... G03G 15/6502
(Continued)

FOREIGN PATENT DOCUMENTS

JP S59128147 A 7/1984
JP 2006089151 A 4/2006
(Continued)

*Primary Examiner* — Leslie A Nicholson, III
(74) *Attorney, Agent, or Firm* — Rossi, Kimms & McDowell LLP

(57) ABSTRACT

A sheet storage apparatus attached to an apparatus body in an attaching direction includes a sheet storage portion configured to store a sheet, a moving unit movably supported by the sheet storage portion in a moving direction parallel to the attaching direction, wherein the moving unit includes a regulation member and an extending member extending in the moving direction, the regulation member including a regulation surface regulating a position, in the moving direction, of the sheet stored in the sheet storage portion, and a first bonding surface extending along the moving direction, the extending member including a second bonding surface extending parallel to the first bonding surface, and wherein the first bonding surface and the second bonding surface are configured to be bonded to each other by adhesive.

18 Claims, 12 Drawing Sheets

(56) References Cited

U.S. PATENT DOCUMENTS

| | | | | |
|---|---|---|---|---|
| 10,183,820 | B2 * | 1/2019 | Yoshida | B65H 1/266 |
| 10,233,041 | B2 * | 3/2019 | Okazaki | G03G 15/6502 |
| 10,865,063 | B2 * | 12/2020 | Takahashi | B65H 1/04 |
| 11,281,148 | B2 * | 3/2022 | Seto | G03G 21/1619 |
| 2006/0244203 | A1 * | 11/2006 | Kirby | B65H 31/20 271/162 |
| 2021/0403264 | A1 * | 12/2021 | Murayama | G03G 15/6514 |

FOREIGN PATENT DOCUMENTS

| | | | |
|---|---|---|---|
| JP | 2010116227 | A | 5/2010 |
| JP | 2016210529 | A | 12/2016 |

* cited by examiner

SHEET STORAGE APPARATUS AND IMAGE FORMING APPARATUS

BACKGROUND OF THE INVENTION

Field of the Invention

This invention relates to a sheet storage apparatus storing a sheet and an image forming apparatus including this sheet storage apparatus.

Description of the Related Art

Generally, an image forming apparatus such as a printer includes a cassette capable of storing a sheet in a lower part of the apparatus, and forms an image on the sheet fed from the cassette. The cassette is disposed in such a manner that is capable of attaching to and drawing out from an apparatus body, and a pair of cursors regulating positions of side edges of a stored sheet are movably disposed in the cassette.

Hitherto, an image forming apparatus in which a groove is formed in a front side wall of a cassette body and a protrusion is disposed on each of the cursors is suggested (refer to Japanese Patent Laid-Open No. 2006-89151). When the cassette is attached to the apparatus body, a mobile carriage supporting the pair of cursors moves, and the protrusions disposed on the pair of cursors engage with the groove in the front side wall of the cassette body. Herewith, the intensity of the pair of cursors with respect to the external force in a width direction is increased, and, even if the cassette is thrusted into the apparatus body, the cursor is able to withstand such an impact.

However, since a linking mechanism to move the mobile carriage in conjunction with an attachment and a detachment of the cassette is necessary for the image forming apparatus described in Japanese Patent Laid-Open No. 2006-89151 mentioned above, a number of components and assembling man-hours are increased. Therefore, cost is increased.

SUMMARY OF THE INVENTION

According to a first aspect of the present invention, a sheet storage apparatus attached to an apparatus body in an attaching direction includes a sheet storage portion configured to store a sheet, a moving unit movably supported by the sheet storage portion in a moving direction parallel to the attaching direction, wherein the moving unit includes a regulation member and an extending member extending in the moving direction, the regulation member including a regulation surface regulating a position, in the moving direction, of the sheet stored in the sheet storage portion, and a first bonding surface extending along the moving direction, the extending member including a second bonding surface extending parallel to the first bonding surface, and wherein the first bonding surface and the second bonding surface are configured to be bonded to each other by adhesive.

According to a second aspect of the present invention, a sheet storage apparatus attached to an apparatus body in an attaching direction includes a sheet storage portion configured to store a sheet, a moving unit movably supported by the sheet storage portion in a moving direction parallel to the attaching direction, wherein the moving unit includes a regulation member and an extending member extending in the moving direction, the regulation member including a regulation surface regulating a position, in the moving direction, of the sheet stored in the sheet storage portion, and a first bonding surface extending along the moving direction, the extending member including a second bonding surface extending parallel to the first bonding surface, and wherein the first bonding surface and the second bonding surface are configured to be bonded to each other by double-sided tape.

According to a third aspect of the present invention, a sheet storage apparatus attached to an apparatus body in an attaching direction includes a sheet storage portion configured to store a sheet, and a moving unit movably supported by the sheet storage portion in a moving direction parallel to the attaching direction, wherein the moving unit includes a regulation member and an extending member extending in the moving direction, the regulation member including a regulation surface regulating a position, in the moving direction, of the sheet stored in the sheet storage portion and a first bonding surface extending along the moving direction, the extending member including a second bonding surface extending parallel to the first bonding surface, and wherein the first bonding surface and the second bonding surface are configured to be bonded to each other without being fastened by a fastening member.

Further features of the present invention will become apparent from the following description of exemplary embodiments with reference to the attached drawings.

DESCRIPTION OF THE EMBODIMENTS

First Embodiment

General Arrangement

At first, a first embodiment of this disclosure will be described. A printer 1 which is an image forming apparatus relating to the first embodiment is a laser beam printer of an electrophotographic system. To be noted, the scope of this disclosure is not limited by sizes, materials, shapes, relative arrangements, and the likes of components described in the following embodiments unless otherwise specifically stated.

Figure 1:
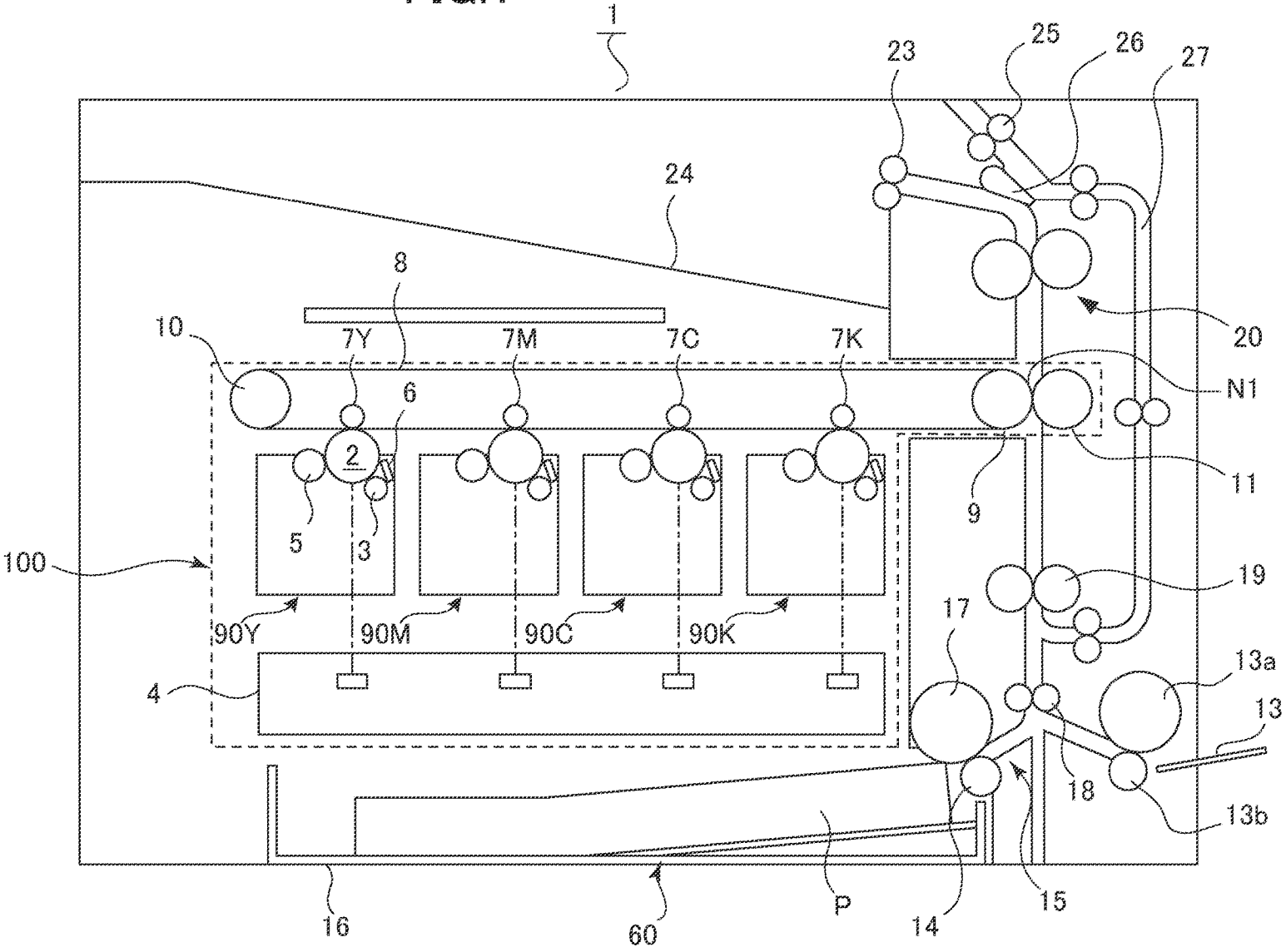
FIG. 1 is a schematic view showing a general arrangement of a printer relating to a first embodiment.

As shown in FIG. 1, the printer 1 includes an image forming unit 100 forming an image on a sheet P, a sheet feeding unit 15, a fixing unit 20, a sheet discharge roller pair 23, and an inversion roller pair 25. The image forming unit 100 includes four process cartridges 90Y, 90M, 90C, and 90K respectively forming toner images of four colors of yellow (Y), magenta (M), cyan (C), and black (K), and a scanner unit 4.

To be noted, the four process cartridges 90Y, 90M, 90C, and 90K are the same in configurations except for differences in the colors of formed images. Accordingly, only the configuration and an image forming process of the process cartridge 90Y will be described, and descriptions of the other process cartridges 90M, 90C, and 90K will be omitted herein.

The process cartridge 90Y includes a photosensitive drum 2, a charge roller 3, a developing roller 5, and a cleaning blade 6. The photosensitive drum 2 is coated with an organic photo conductive layer around an outer circumferential surface of an aluminum cylinder, and is rotatably driven by a driving motor, not shown. Further, an intermediated transfer belt 8 wound around a driving roller 9 and a tension roller 10 is disposed in the image forming unit 100, and primary transfer rollers 7Y, 7M, 7C, and 7K are disposed inside the intermediated transfer belt 8. Further, a secondary transfer roller 11 is disposed across the intermediated transfer belt 8 opposite the driving roller 9, and the intermediated transfer belt 8 and the secondary transfer roller 11 form a transfer nip N1 transferring the image to the sheet P that is conveyed.

The sheet feeding unit 15 is disposed in a lower part of the printer 1, and includes a cassette 16 storing the sheet P, a pickup roller 17, serving as a sheet feeding unit, supported by the cassette 16 and capable of feeding the sheet P, and a separation roller 14. The fixing unit 20 includes a fixing roller and a press roller providing the heat and the pressure to the sheet.

Next, an image forming operation of the printer 1 which is configured as described above will be described. When an image signal is input to the scanner unit 4 from a personal computer, not shown, and the like, a laser beam corresponding to the image signal is irradiated from the scanner unit 4 onto the photosensitive drum 2 in the process cartridge 90Y.

At this time, a surface of the photosensitive drum 2 has been uniformly charged at a predetermined polarity and electric potential by the charge roller 3 beforehand, and, by irradiated with the laser beam by the scanner unit 4, an electrostatic latent image is formed on the surface. The electrostatic latent image formed on the photosensitive drum 2 is developed by the developing roller 5, and the toner image of yellow (Y) is formed on the photosensitive drum 2.

Similarly, the laser beam is irradiated to each of the photosensitive drums 2 in the process cartridges 90M, 90C, and 90K from the scanner unit 4, and the toner images of magenta (M), cyan (C), and black (K) are formed on the respective photosensitive drums. The toner image of each color formed on each photosensitive drum is transferred to the intermediated transfer belt 8 by the primary transfer rollers 7Y, 7M, 7C, and 7K, and is conveyed to transfer nip N1 by the intermediated transfer belt 8 rotatably driven by the driving roller 9. To be noted, the image forming process of each color is performed in a timing superimposing the toner image on an upstream toner image which has been primarily transferred onto the intermediated transfer belt 8. To be noted, after the toner image has been transferred by the primary transfer roller 7Y, the toner remained on the photosensitive drum 2 is collected by the cleaning blade 6.

In parallel with this image forming process, the sheet P stored in the cassette 16 of the sheet feeding unit 15 is sent out by the pickup roller 17, and is separated into one sheet a time by the separation roller 14. Then, the skew of the sheet P is corrected by a conveyance roller pair 18 and a registration roller pair 19, and the sheet P is conveyed by the registration roller pair 19 in a predetermined timing synchronizing with a transfer timing of the image at the transfer nip N1. To be noted, the printer 1 includes a manual feed tray 13 on which the sheet P is loaded, and it is also acceptable to feed the sheet P loaded on the manual feeding tray 13 by a manual feeding roller 13*a* and a separation roller 13*b*.

Then, a full color toner image on the intermediated transfer belt 8 is transferred to the sheet P at the transfer nip N1 by a secondary transfer bias applied to the secondary transfer roller 11. The toner remained on the intermediated transfer belt 8 is collected by a cleaning apparatus, not shown. The sheet P on which the toner image has been transferred is provided with the predetermined heat and pressure at the fixing unit 20, and the toner is melted and bonded (fixed). The sheet P passed through the fixing unit 20 is guided to the sheet discharge roller pair 23 by a guide member 26, and discharged to a sheet discharge tray 24 by the sheet discharge roller pair 23.

When a duplex printing job to form the image on both surfaces of the sheet P is input, the sheet P on whose surface the image has been formed by the transfer nip N1 is guided to the inversion roller pair 25 by the guide member 26. Then, the sheet P is inverted by the inversion roller pair 25, and conveyed to a duplex conveyance path 27. The sheet P guided to the duplex conveyance path 27 is again conveyed to the registration roller pair 19, and, after the image has been formed on a back surface at the transfer nip N1, is discharged to the sheet discharge tray 24 by the sheet discharge roller pair 23.

Sheet Storage Apparatus

Figure 2:
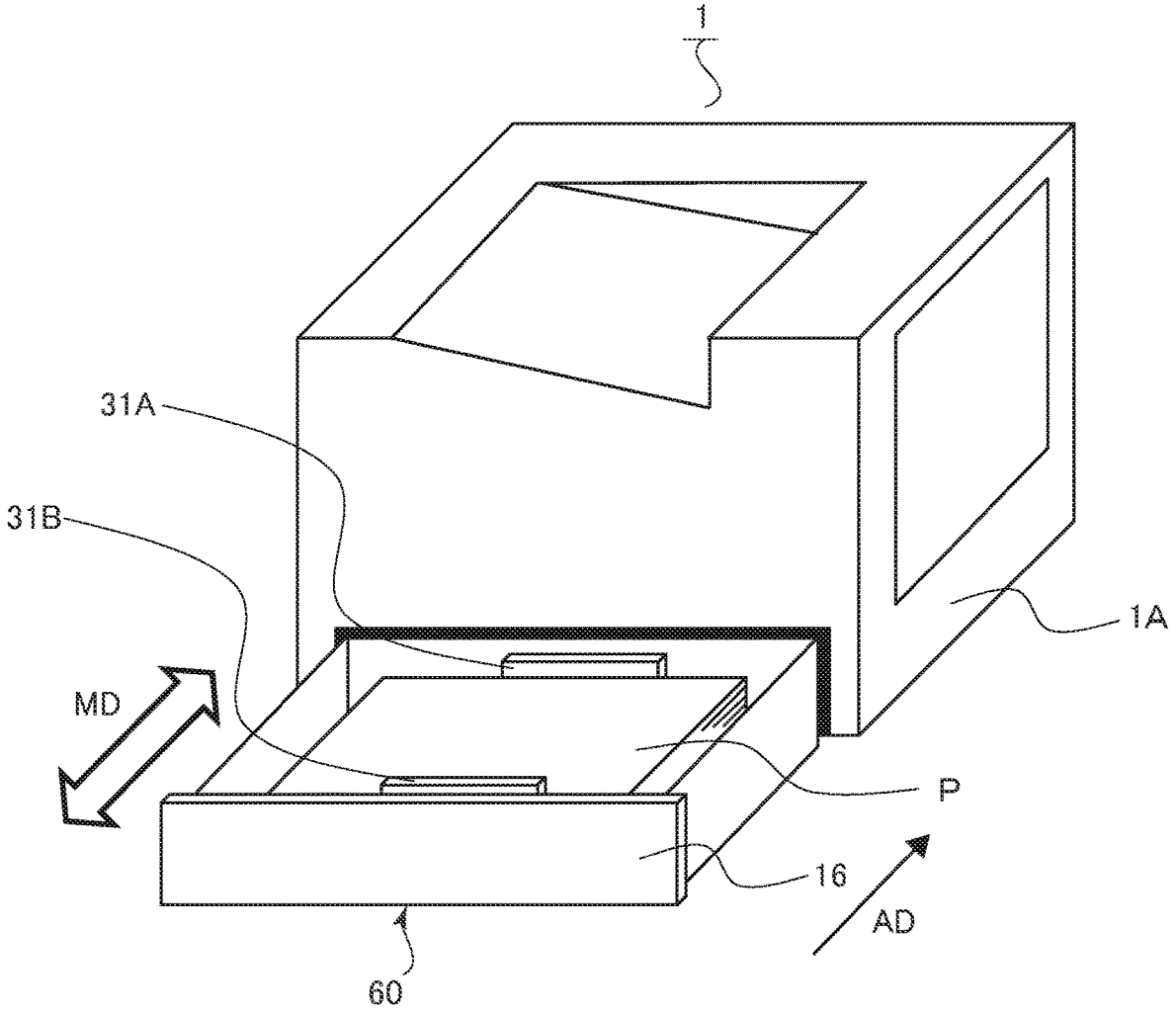
FIG. 2 is a perspective view showing a state where a cassette has been drawn out from an apparatus body.
Figure 3:
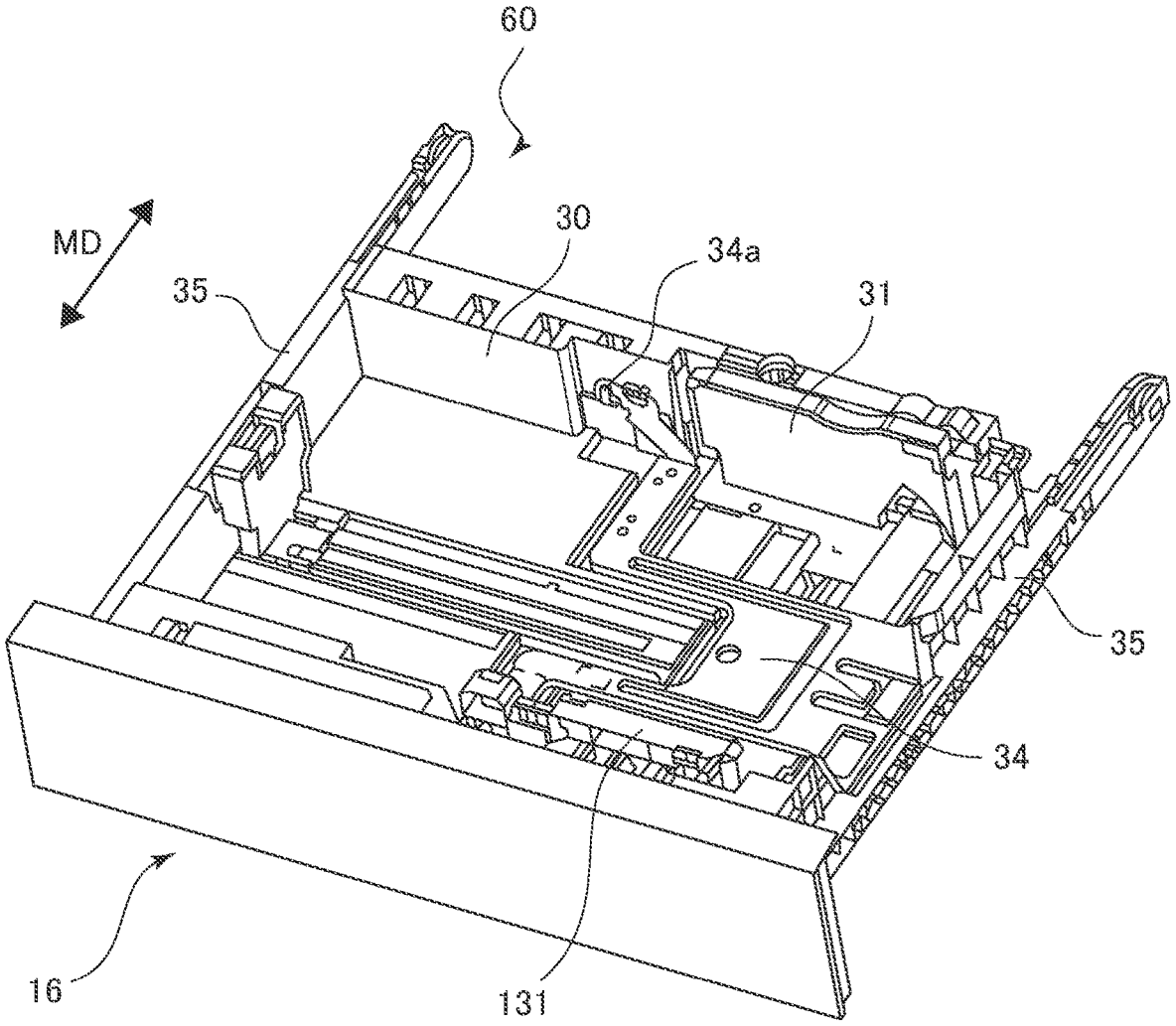
FIG. 3 is a perspective view showing a sheet storage apparatus.
Figure 4:
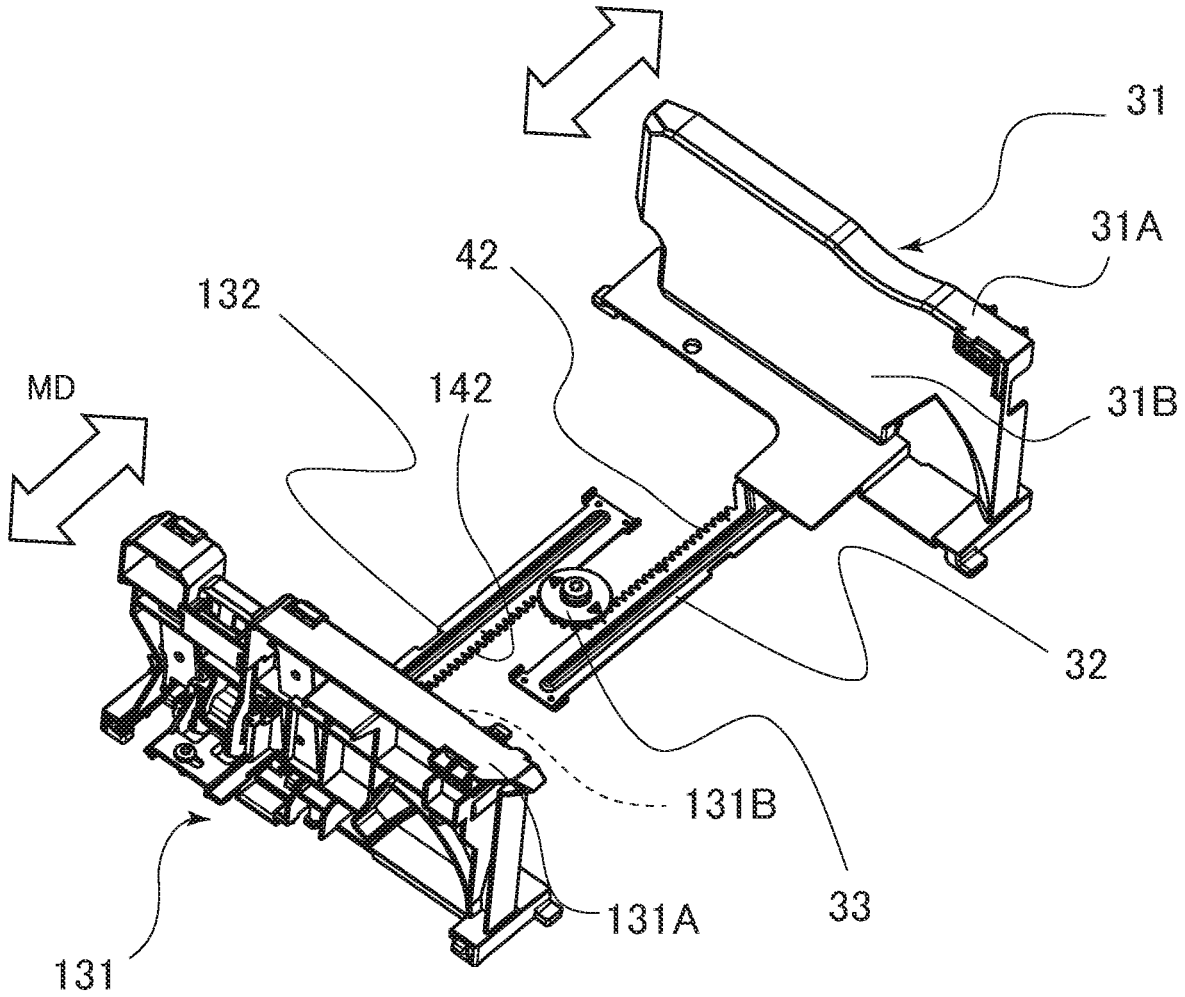
FIG. 4 is a perspective view showing a pair of side regulation plates.

Next, regarding a sheet storage apparatus 60, the cassette 16 and an internal configuration of the cassette 16 will be described in detail. As shown in FIGS. 2 to 4, the sheet storage apparatus 60 includes the cassette 16 which is capable of attaching to and being drawn out from an apparatus body 1A of the printer 1. That is, the sheet storage apparatus 60 including the cassette 16 is attached to the apparatus body 1A in an attaching direction AD. The cassette 16 includes a cassette body 30, serving as a storage portion storing the sheet P, and a pair of guide rails 35. The pair of guide rails 35, serving as guided portions, are disposed at both sides of the cassette body 30, extend in the attaching direction AD, and, when the sheet storage apparatus 60 is attached to the apparatus body 1A in the attaching direction AD, slide towards the apparatus body 1A.

Further, the sheet storage apparatus 60 includes a lift plate 34 supported, with respect to the cassette body 30, pivotably around a pivot shaft 34*a* as center and stacking the sheet P, and a pair of side regulation plates 31 and 131 movably supported in a moving direction MD with respect to the cassette body 30. Further, the sheet storage apparatus 60 includes a trailing edge regulation plate 65 regulating a position of a trailing edge of the sheet P stacked on the lift plate 34, and a pinion gear 33, serving as a gear member, rotatably supported with respect to the cassette body 30. To be noted, in this embodiment, the moving direction MD is a direction parallel to the attaching direction AD and a drawing out direction of the cassette 16 with respect to the apparatus body 1A, and is a width direction orthogonal to a sheet feeding direction. Further, the direction parallel to the attaching direction AD includes a direction that is within ten degrees with respect to the attaching direction AD, and it is acceptable if the moving direction MD is within ten degrees with respect to the attaching direction AD.

The pair of guide rails 35 slide on apparatus body side rails, not shown, disposed on the apparatus body 1A, so that the cassette 16 is guided towards the apparatus body 1A smoothly. When an image forming job is started, the lift plate 34 ascends to a position where an uppermost sheet stacked on the lift plate 34 comes into contact with the pickup roller 17.

As shown in FIG. 4, the side regulation plate 31, serving as a moving unit and a first moving unit, is constructed by a regulation member 31A, serving as a first regulation member, and a rack member 32, serving as an extending member and a first extending member. The regulation member 31A includes a regulation surface 31B regulating a position, in the moving direction MD, of the sheet stored in the cassette body 30. The side regulation plate 131, serving as a second moving unit, is also constructed by a regulation member 131A, serving as a second regulation member, and a rack member 132, serving as a second extending member. The regulation member 131A includes a regulation surface 131B regulating a position of the sheet stored in the cassette body 30 in the moving direction MD. The cassette body 30 and the regulation members 31A and 131A are made from resin material, and the rack members 32 and 132 are made from metal material such as sheet metal.

The rack members 32 and 132 respectively include rack portions 42 and 142 capable of engaging with the pinion gear 33, and these rack portions 42 and 142 are disposed so as to face each other across the pinion gear 33. Then, when either one of the side regulation plates 31 and 131 is moved by a user in the moving direction MD, the other one of the side regulation plates 31 and 131 is configured to move in the moving direction MD by actions of the rack portions 42 and 142 and the pinion gear 33. At this time, the side regulation plates 31 and 131 move in directions opposite each other in the moving direction MD. For example, when the side regulation plate 31 moves in a predetermined direction inside the moving direction MD, the side regulation plate 131 moves in an opposite direction of the predetermined direction.

Hereinafter, since the side regulation plates 31 and 131 are almost similar in configurations, only the side regulation plate 31 will be described in detail, and descriptions of the side regulation plate 131 will be omitted herein.

Detailed Configurations of Bonding Portion of Side Regulation Plate

Figure 5:
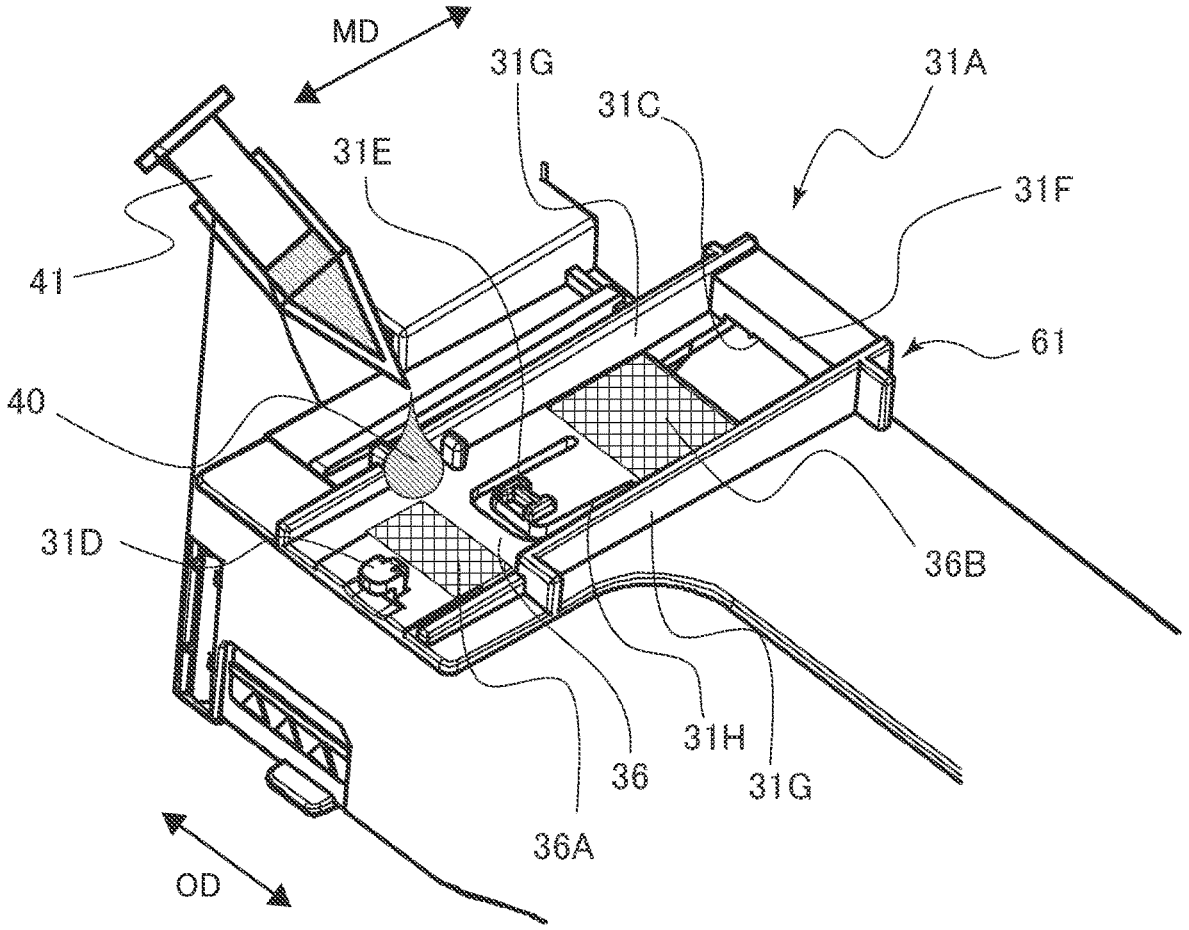
FIG. 5 is a perspective view showing a detailed configuration of a bonding portion of a regulation member.

As described later, the regulation member 31A and the rack member 32 constructing the side regulation plate 31 are bonded to each other by adhesive. At first, using FIG. 5, a bonding portion 61 of the regulation member 31A will be described in detail. As shown in FIG. 5, the bonding portion 61 includes a bonding surface 36, serving as a first bonding surface extending parallel to the moving direction MD, a pair of guide ribs 31G and 31G protruding upwards from the bonding surface 36, and a regulation rib 31F disposed so as to couple the guide ribs 31G and 31G to each other. The bonding surface 36 includes adhesive coating surfaces 36A and 36B on which the adhesive 40 is coated by an adhesive coater 41.

The pair of guide ribs 31G and 31G, serving as a wall portion, are disposed so as to face each other across the adhesive coating surfaces 36A and 36B in an orthogonal direction OD orthogonal to the moving direction MD, and extend along the moving direction MD. The regulation rib 31F extends in the orthogonal direction OD so as to couple the pair of guide ribs 31G and 31G to each other. Therefore, these guide ribs 31G, 31G, and regulation rib 31F are formed approximately in a rectangular with one side open shape so that it is possible to easily position the rack member 32.

A hole portion 31C capable of accommodating insertion of a tip portion 32C (refer to FIG. 6) of the rack member 32 is formed below the regulation rib 31F. Further, a hook portion 31D, having an L-shaped cross section while protruding upwards from the bonding surface 36, and a snap fit 31E protruding upwards from the bonding surface 36 are formed on the bonding surface 36. Since a groove 31H is formed in a rectangular with one side open shape around the snap fit 31E, the snap fit 31E is easily deformed elastically in a height direction.

Detailed Configurations of Bonding Portion of Rack Member

Figure 6:
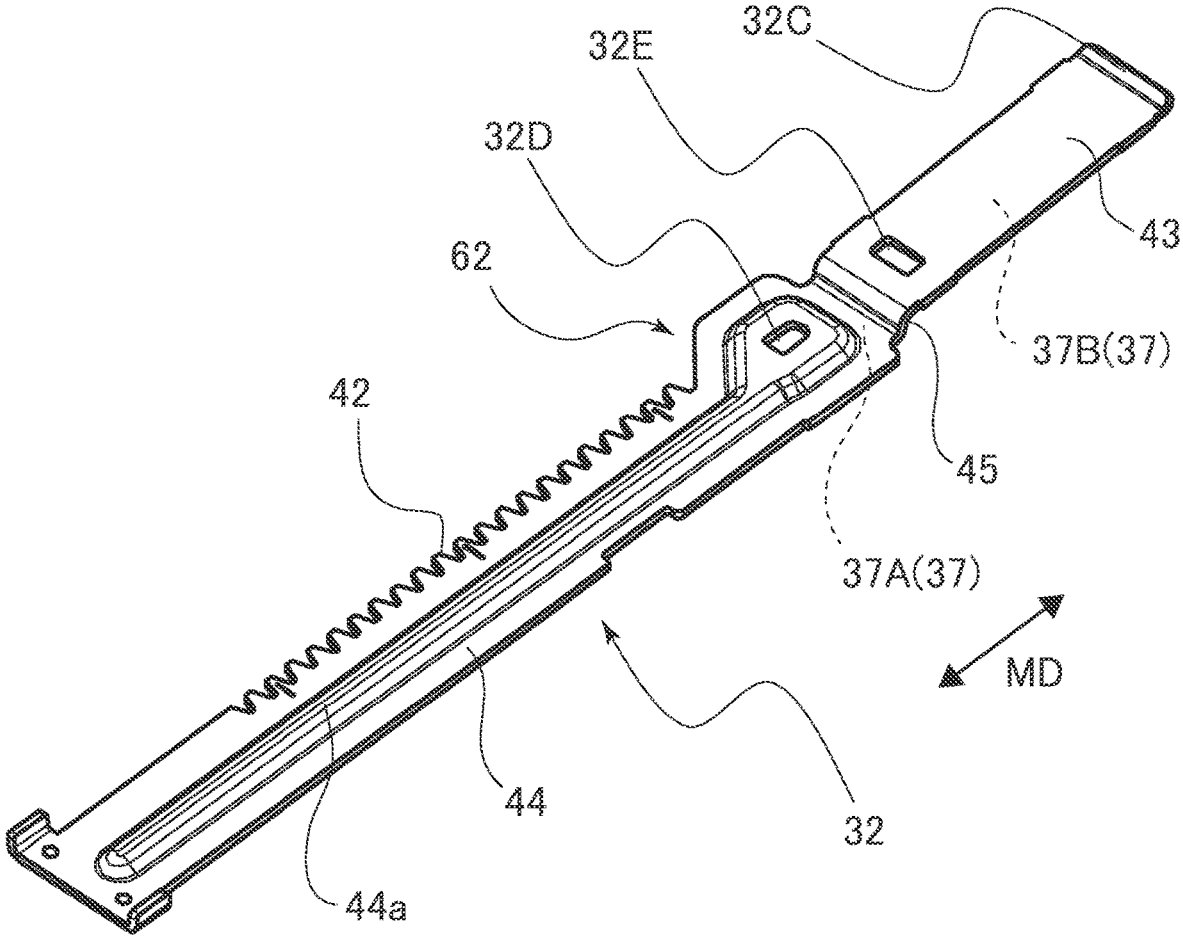
FIG. 6 is a perspective view showing a detailed configuration of a bonding portion of a rack member.

Next, using FIG. 6, a bonding portion 62 of the rack member 32 will be described in detail. As shown in FIG. 6, the bonding portion 62 includes a first portion 43 including the tip portion 32C, a second portion 44 including a rack portion 42, and a step portion 45 connecting the first portion 43 and the second portion 44. The step portion 45 couples one end of the first portion 43 to one end of the second portion 44 in the height direction.

A convex portion 44*a* protruding upwards is formed on the second portion 44 by a press working and the like, and formed lengthily approximately over a whole length of the second portion 44 in the moving direction MD. The intensity of the rack member 32 is improved by these step portion 45 and convex portion 44*a*.

The rack member 32 includes a bonding surface 37, serving as a second bonding surface, bonded to the bonding surface 36 of the regulation member 31A by the adhesive 40 and extending parallel to the first bonding surface 36. The bonding surface 37 includes a first adhered surface 37A formed on the second portion 44 and capable of being adhered to the adhesive coating surface 36A of the regulation member 31A, and a second adhered surface 37B formed on the first portion 43 and capable of being adhered to the adhesive coating surface 36B of the regulation member 31A. A rectangular hole 32D is formed in the convex portion 44*a* of the second portion 44, and a snap fit hole 32E is formed in the first portion 43.

Bonding Method to Bond Regulation Member and Rack Member

Figure 7A:
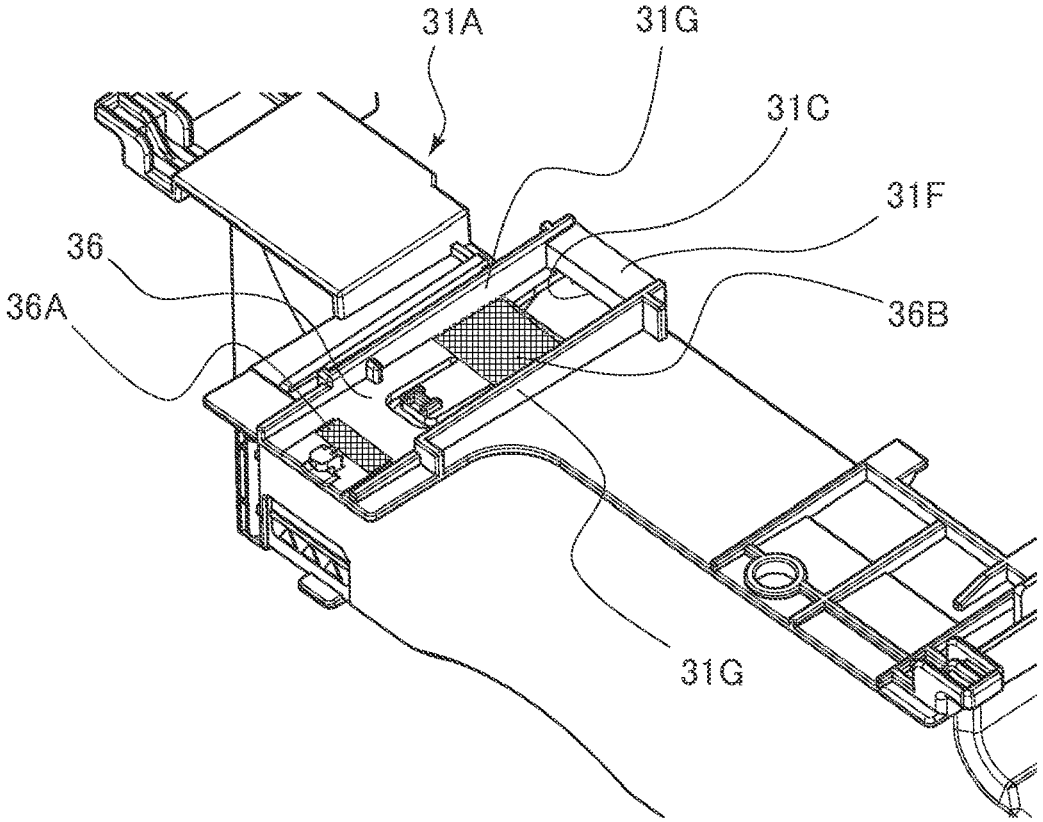
FIG. 7A is a perspective view showing the regulation member on which an adhesive has been coated.

Next, using FIGS. 7A to 8B, a bonding method to bond the regulation member 31A and the rack member 32 will be described. At first, as shown in FIG. 7A, an assembly worker (hereinafter simply referred to as a worker) coats the adhesive 40 on the adhesive coating surfaces 36A and 36B of the regulation member 31A with the adhesive coater 41. To be noted, an assembly process of this embodiment is not limited to the manual work by personnel, and it is acceptable to perform the process by a mechanical means.

Figure 7B:
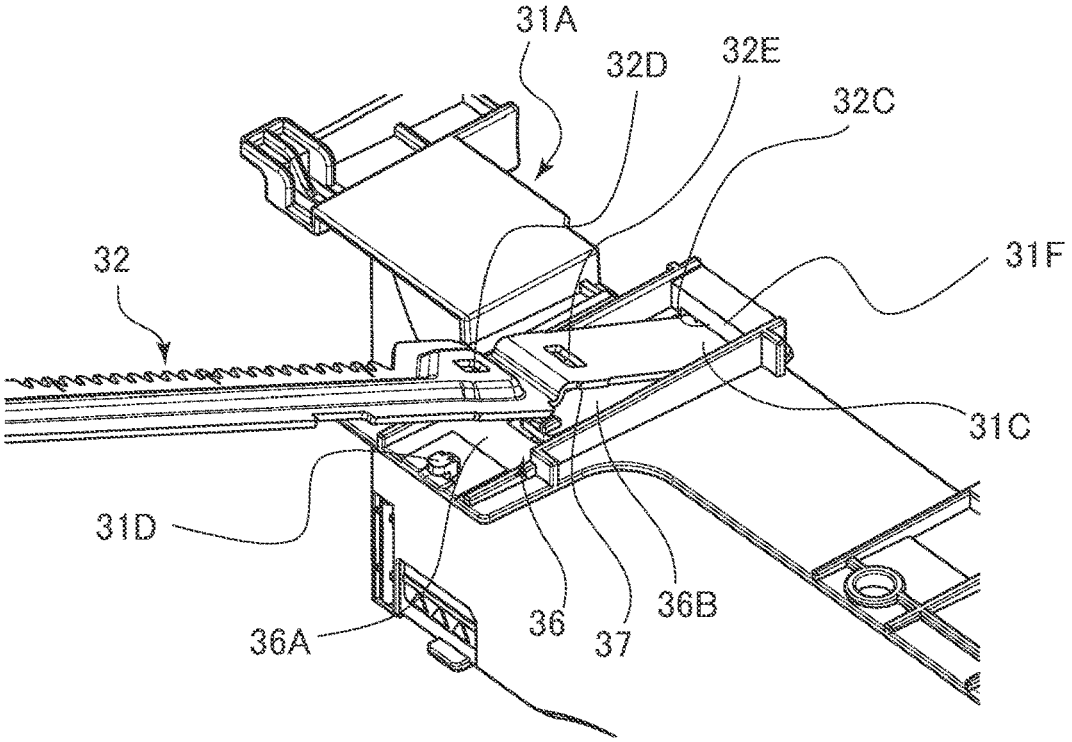
FIG. 7B is a perspective view showing a state where the rack member is being inserted into the regulation member.
Figure 8A:
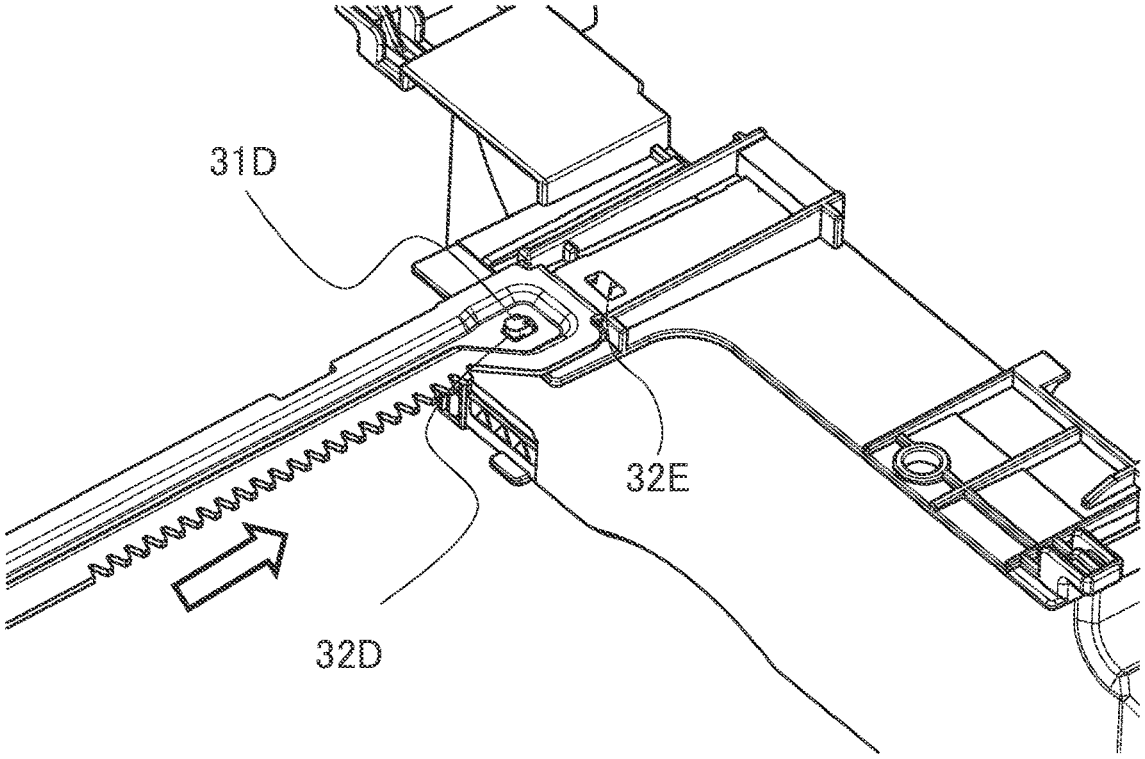
FIG. 8A is a perspective view showing a state where a hook portion is inserted into a rectangular hole.
Figure 8B:
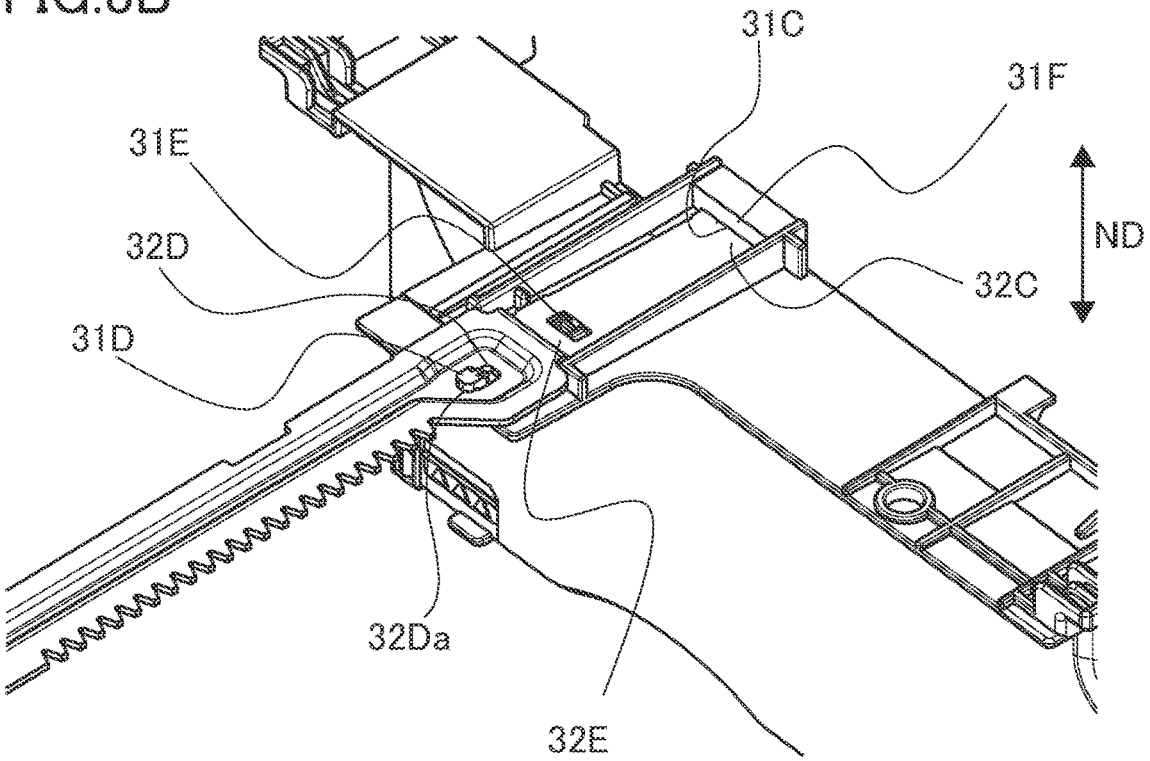
FIG. 8B is a perspective view showing a state where the rack member has been slid with respect to the regulation member.

Then, as shown in FIG. 7B, the worker inserts the tip portion 32C into the hole portion 31C while tilting a posture of the rack member 32 with respect to the rack member 32 so that the rack member 32 does not come into contact with the adhesive coating surfaces 36A and 36B. Next, as shown in FIG. 8A, the worker rotates the rack member 32, and fits the bonding surface 37 of the rack member 32 on the bonding surface 36 of the regulation member 31A. To be noted, at this time, the snap fit 31E of the regulation member 31A is elastically deformed downwards by being pressed with the rack member 32.

Since the pair of guide ribs 31G and 31G are formed on the regulation member 31A, by rotating the rack member 32 between the guide ribs 31G and 31G, it is possible to easily position the rack member 32 correctly. Further, since the guide ribs 31G and 31G are disposed so as to enclose the adhesive coating surfaces 36A and 36B, even if the adhesive 40 of a low viscosity is coated on the adhesive coating surfaces 36A and 36B, it is possible to reduce an effluence of the adhesive 40 from the bonding surface 36 to other areas. Further, since the bonding surface 36 is divided from the other areas by the guide ribs 31G and 31G, it is possible to define a coating position of the adhesive 40. Therefore, it is possible to improve assemblability.

Then, when the bonding surfaces 36 and 37 are fitted on each other, the hook portion 31D of the regulation member 31A is inserted into the rectangular hole 32D of the rack member 32. Next, the worker positions the snap fit 31E and the snap fit hole 32E at a correct position by slidingly moving the rack member 32 to a side of the tip portion 32C. Herewith, the snap fit 31E swings upwards, and engages with the snap fit hole 32E. To be noted, similar assembling and positioning methods as described above are also applied to the side regulation plate 131.

In a state where the rack member 32 is assembled to the regulation member 31A, relative movements of the regulation member 31A and the rack member 32 in a debonding direction of the bonding surfaces 36 and 37, namely, in a normal line direction ND of the bonding surfaces 36 and 37 are regulated by the hook portion 31D and the regulation rib 31F. In more particular, the hook portion 31D of the regulation member 31A and the regulation rib 31F respectively engage with an edge portion 32Da of the rectangular hole 32D formed in the rack member 32 and the tip portion 32C. In other words, when viewed in the normal line direction ND, the hook portion 31D and the regulation rib 31F are positioned at positions which respectively overlap the edge portion 32Da and the tip portion 32C. To be noted, the hook portion 31D and the regulation rib 31F constitute a first engagement portion, and the edge portion 32Da and the tip portion 32C constitute a second engagement portion.

Therefore, it is possible to supplement the intensity of the adhesive 40 in the debonding direction (in the normal line direction ND), and possible to improve the accuracy of relative positions of the regulation member 31A and the rack member 32 in the normal line direction ND.

Further, by engagement of the snap fit 31E and the snap fit hole 32E, the relative movements of the regulation member 31A and the rack member 32 in a shearing direction of the bonding surfaces 36 and 37, namely, in a direction parallel to the bonding surfaces 36 and 37 are regulated. Therefore, after the bonding surfaces 36 and 37 were bonded by the adhesive 40, it is not necessary to lock the regulation member 31A and the rack member 32 by a clamping tool and the like during a time until the adhesive 40 has stiffened to a practical shear strength. For example, in a case where the practical shear strength of the adhesive 40 is equal to or more than 23 kgf (kilogram force), it takes about 8 minutes for the adhesive 40 to stiffen. To be noted, the snap fit 31E constitutes a third engagement portion, and the snap fit hole 32E constitutes a fourth engagement portion engaging with the third engagement portion.

As described above, by temporarily fixing the regulation member 31A and the rack member 32 by engaging the snap fit 31E with the snap fit hole 32E, without needing a special tool, it is possible to assemble the regulation member 31A and the rack member 32 at low cost and easily. Further, if external force is not exerted to the regulation member 31A and the rack member 32 in the temporarily fixed state, it is possible to move to a next assembly process and also proceed to assemble to the cassette 16.

Replenishment of Sheet to Cassette

Figure 9A:
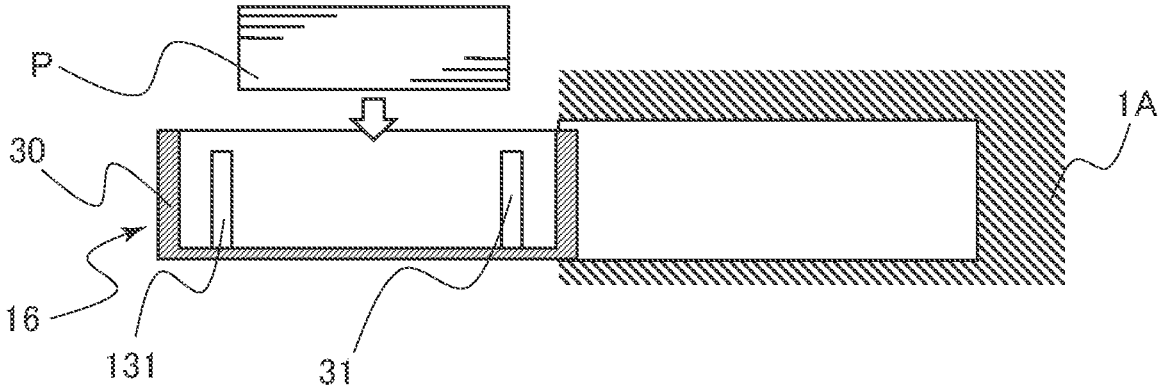
FIG. 9A is a cross-sectional view showing a state where a sheet is being replenished to the cassette.

Next, a sheet replenishing operation to the cassette 16 will be described. As shown in FIG. 9A, at a time of replenishing the sheet P to the cassette 16, at first, a user draws out the cassette 16 from the apparatus body 1A. Then, the user sets the sheet P in the cassette 16, and aligns the side regulation plates 31 and 131 with side edges of the sheet P.

Figure 9B:
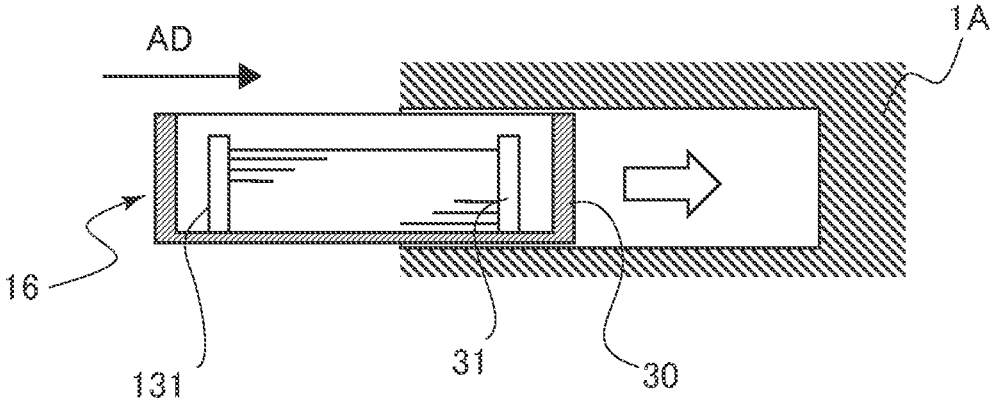
FIG. 9B is a cross-sectional view showing a state where the cassette is being attached to the apparatus body.

Thereafter, as shown in FIG. 9B, the user attaches the cassette 16 to the apparatus body 1A in the attaching direction AD. At this time, the cassette 16 is attached to the apparatus body 1A smoothly by the guide rail 35 disposed on the cassette 16. Then, the cassette 16 is positioned at an attached position by abutting a positioning portion disposed on the cassette 16 or the guide rail 35 onto an abutment portion disposed on the apparatus body 1A.

At this time, a case where the cassette 16 is thrusted into the apparatus body 1A is considered. When the cassette 16 abuts on the apparatus body 1A at the attached position, the sheet P presses the side regulation plate 31 in the moving direction MD (in the attaching direction AD) by the law of inertia.

At this point, in this embodiment, the regulation member 31A and the rack member 32 are bonded by adhering the bonding surfaces 36 and 37 extending parallel to the moving direction MD with the adhesive 40. Therefore, a load exerted to the regulation member 31A of the side regulation plate 31 from the sheet P acts as the shearing force on the bonding surfaces 36 and 37 between the regulation member 31A and the rack member 32.

However, since the adhesive 40 is strong in the shear strength, when the above load is exerted, the bonding of the bonding surfaces 36 and 37 is maintained, and it is possible to reduce the breakage of the regulation member 31A and the rack member 32. Further, since the bonding of the bonding surfaces 36 and 37 with the adhesive 40 is performed without fastening by a fastening member such as a screw and achieved at low cost, it is possible to construct the side regulation plate 31 at low cost and high intensity. Therefore, it is possible to suppress a wobble between the regulation member 31A and the rack member 32, and reduce the dispersion of printing precision. Further, since it is not necessary to dispose a damping member such as a damper between the cassette 16 and the apparatus body 1A, the cost reduction in and the miniaturization of the apparatus are enabled.

Figure 9C:
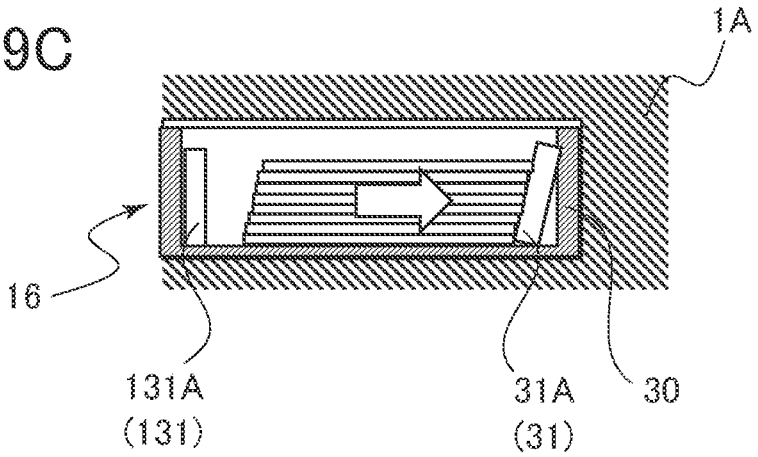
FIG. 9C is a cross-sectional view showing a state where the regulation member has abutted on the cassette body.

Further, in the case where the cassette 16 is thrusted into the apparatus body 1A, as shown in FIG. 9C, in some cases, by being pushed by the sheet P, the regulation member 31A of the side regulation plate 31 comes into contact with the cassette body 30. At this time, the side regulation plate 131 synchronizing with the side regulation plate 31 moves in a direction away from the sheet P. The regulation member 31A of the side regulation plate 31 comes into contact with the cassette body 30 while some brakes are being applied by the engagement resistance between the rack members 32 and 132 of the side regulation plates 31 and 131 and the pinion gear 33, and the sliding resistance at a time of the movements of the side regulation plates 31 and 131.

Further, since the sheet P stored in the cassette 16 is also not a rigid body, the sheet P adsorbs an impact at a time when the regulation member 31A comes into contact with the cassette body 30. Further, since the regulation member 31A and the cassette body 30 are formed from resin material, the regulation member 31A and the cassette body 30 each deform elastically so that the impact is absorbed. Further, since the regulation member 31A is formed from resin material, at a time of colliding with the cassette body 30, the regulation member 31A is not plastically deformed to bend as sheet metal so that it is possible to regulate the position of the sheet precisely.

As described above, since the load exerted to the regulation member 31A from the sheet P is alleviated to some extent, combined with the high intensity of the shear strength of the adhesive 40 mentioned above, it is possible to reduce the deformation and the positional displacement of the regulation member 31A and the rack member 32. Further, since the rack member 32 is formed from metal material, it is possible to suppress a bend so as to reduce a tooth jump with respect to the pinion gear 33.

Shear Strength

Next, the shear strength of the adhesive 40 coated on the bonding surfaces 36 and 37 in this embodiment will be described. For example, in a case where 500 sheets of the sheet of an A4 size having a grammage of 80 g/m$^2$ are stacked inside the cassette 16, the weight of these sheets becomes about 2.5 kg. Hereinafter, it is assumed that, in the case where the cassette 16 is thrusted into the apparatus body 1A, the cassette 16 is attached at a cassette attaching speed of 2.2 m/sec which is about 1.5 times faster than a normal cassette attaching speed of about 1.5 m/sec.

When the cassette 16 abuts on the abutment portion of the apparatus body 1A at this speed, in accordance with an equation (1) relating to kinetic energy, the impact (load) W exerted by the sheet P stored in the cassette 16 on the regulation member 31A becomes as follows:

$$W = 1/2mv^2 (W\text{: work(joule(J))}, m\text{: mass(kg)}, v\text{: velocity(m/sec)}) \quad (1)$$

$$= 6.05$$

The regulation member 31A slides by a few millimeters from a position corresponding to the A4 size sheet, and collides with the cassette body 30. At this time, impact force F is determined by an equation of motion (2), an equation of speed/linear motion (3), and an equation about work (4), $$F=ma \quad (2)$$

(F: force (newton (N), m: mass (kg), a: acceleration (m/sec$^2$))

$$as = ½v^2 \quad (3)$$

(a: acceleration (m/sec$^2$), s: braking distance (m), v: velocity (m/sec))

$$W=Fs \quad (4)$$

(W: work (J), F: force (N), s: braking distance (m))

Therefore, $$W = (ma)s = m(as) = m(1/2v^2)$$

$$F = (1/2mv^2)/s$$

$$= (6.05)/s \ (N)$$

Since, in comparison with the calculation formula, actually, the impact is absorbed by the impact absorption due to the elasticity of the sheet P, the sliding resistance between the rack member 32 and the pinion gear 33, the bend and the deformation of the regulation member 31A, the bend and the deformation of the cassette body 30, and the like, it is assumed that the braking distance is about 10 millimeters.

If s equals 0.01 meter, then F becomes:

$$F=6.05/0.01=605 \text{ (N)}=62 \text{ (kgf)}$$

Therefore, it is assumed that the impact force (shear strength) exerted on the bonding surfaces 36 and 37 of the regulation member 31A and the rack member 32 is 62 kgf.

To be noted, the adhesive 40 used in this embodiment is an acrylic two component structural adhesive (for example, 3921/3926 (trade name) manufactured by ThreeBond Holdigs Co., Ltd., Y611KuroS, Y612BLACK (trade name) manufactured by CEMEDINE Co., Ltd., and the like). The intensity per unit area is 0.38 kgf/mm$^2$.

Since the total area of the adhesive coating surfaces 36A and 36B of the regulation member 31A is 327 mm$^2$, the shear strength becomes 125 kgf. Therefore, there is an intensity margin of twice as large as the calculated impact force of 62 kgf. Incidentally, in a case where the regulation member 31A and the rack member 32 are fastened with an m3 screw (screw of 3 millimeters in nominal diameter), since a piece of the m3 screw is displaced with the shear strength of about 16 kgf, it is not possible to withstand the calculated impact force of 62 kgf by the single screw so that fastening with a plurality of screws is necessary.

At the normal cassette attaching speed of 1.5 m/sec, the impact force is about 25 kgf, and this is about 20% of the shear strength of the adhesive of 125 kgf. Therefore, since it is possible to withstand the impact for about 100,000 times according to an estimation of the repeated breaking strength of the adhesive, there are adequate margins to withstand the impact even after taking into consideration a product life.

As described above, it is possible to bond the bonding surfaces 36 and 37 by the adhesive 40 at low cost, and construct the side regulation plate 31 at low cost and high intensity.

Second Embodiment

Next, while a second embodiment of this disclosure will be described, the second embodiment is constituted by using a double-sided tape 50 instead of the adhesive 40 of the first embodiment. Therefore, configurations similar to the first embodiment will be described by omitting illustrations or by putting the same reference characters on drawings.

Detailed Configurations of Bonding Portion of Side Regulation Plate

Figure 10:
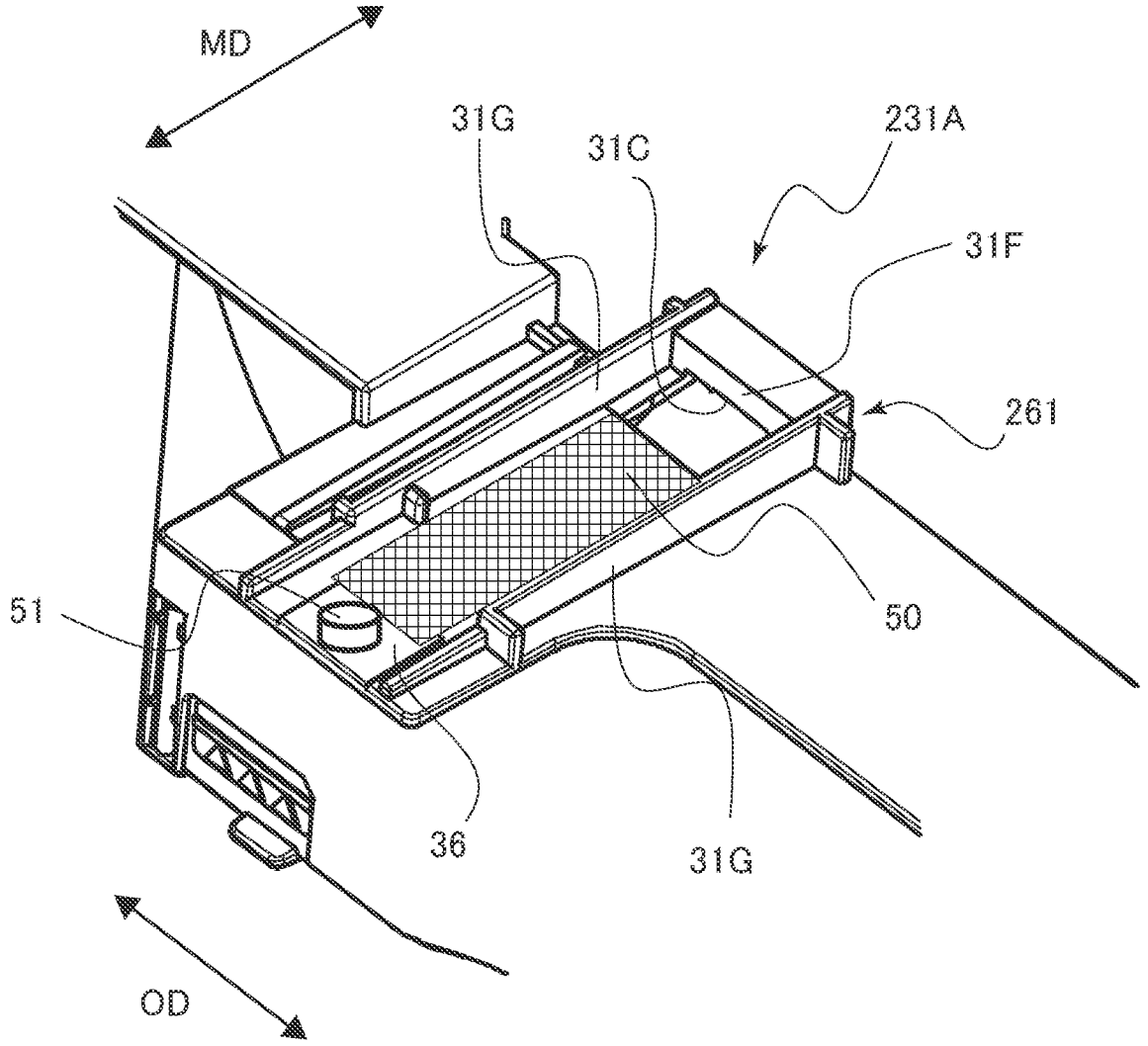
FIG. 10 is a perspective view showing a detailed configuration of a bonding portion of a regulation member relating to a second embodiment.

As described later, a regulation plate 231A, serving as the first regulation member relating to this embodiment, and a rack member 232, serving as the extending member and the first extending member, are bonded to each other by the double-sided tape 50. At first, using FIG. 10, a bonding portion 261 of the regulation plate 231A will be described in detail. As shown in FIG. 10, the bonding portion 261 includes the bonding surface 36 extending in parallel to the moving direction MD, the pair of guide ribs 31G and 31G protruding upwards from the bonding surface 36, and the regulation rib 31F disposed so as to couple the guide ribs 31G and 31G to each other.

The hole portion 31C capable of accommodating the insertion of the tip portion 32C (refer to FIG. 11) of the rack member 232 is formed below the regulation rib 31F. Further, a boss portion 51 protruding upwards from the bonding surface 36 and having a cylindrically shaped cross section is formed on the bonding surface 36.

Detailed Configurations of Bonding Portion of Rack Member

Figure 11:
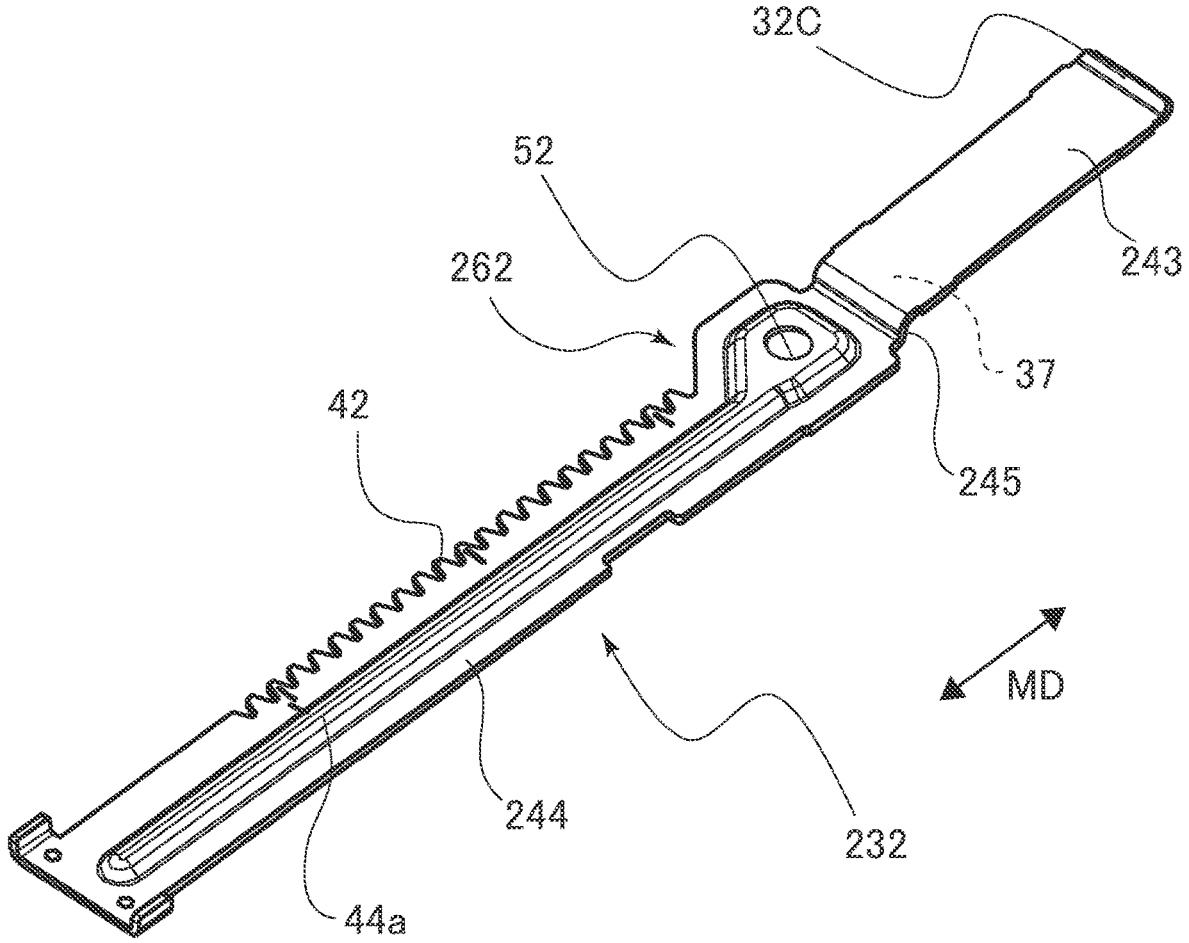
FIG. 11 is a perspective view showing a detailed configuration of a bonding portion of a rack member.

Next, using FIG. 11, a bonding portion 262 of the rack member 232 will be described in detail. As shown in FIG. 11, the bonding portion 262 includes a first portion 243 including the tip portion 32C, a second portion 244 including the rack portion 42, and a step portion 245 coupling the first portion 243 and the second portion 244. The step portion 245 couples one end of the first portion 243 to one end of the second portion 244 in a height direction.

The convex portion 44*a* protruding upwards is formed on the second portion 244 by the press working and the like, and formed lengthily approximately over a whole length of the second portion 244 in the moving direction MD. The intensity of the rack member 232 is improved by these step portion 245 and convex portion 44*a*.

The rack member 232 includes the bonding surface 37 bonded to the bonding surface 36 of the regulation member 231A by the double-sided tape 50 and extending parallel to the first bonding surface 36. A positioning hole 52 is formed in the convex portion 44*a* of the second portion 244.

Bonding Method to Bond Regulation Member and Rack Member

Figure 12A:
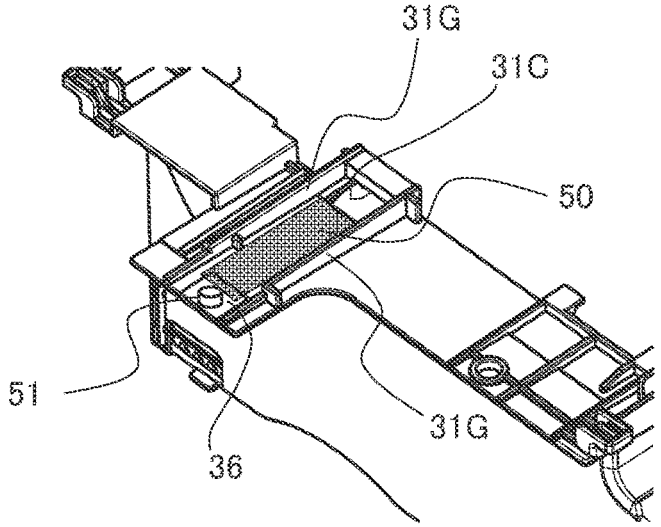
FIG. 12A is a perspective view showing a state where a double-sided tape is sticked onto the regulation member.

Next, using FIGS. 12A to 12C, a bonding method to bond the regulation member 231A and the rack member 232 will be described. At first, as shown in FIG. 12A, the worker sticks the double-sided tape 50 on the bonding surface 36 of the regulation member 231A, and removes a release paper. To be noted, an assembly process of this embodiment is not limited to the manual work by personnel, and it is acceptable to perform the process by a mechanical means.

Figure 12B:
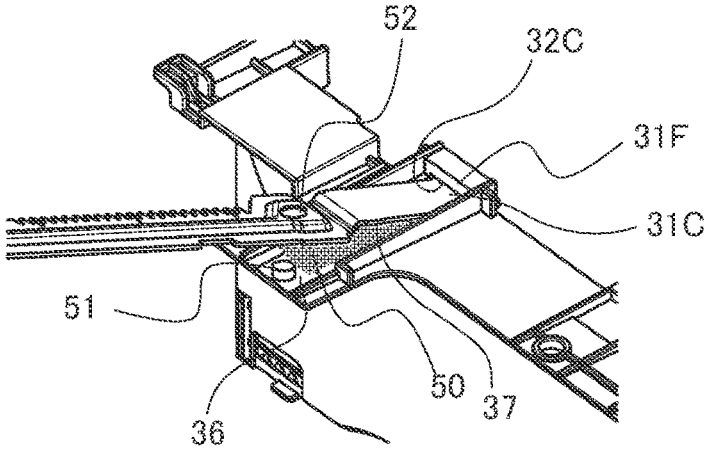
FIG. 12B is a perspective view showing a state where the rack member is being inserted into the regulation member.
Figure 12C:
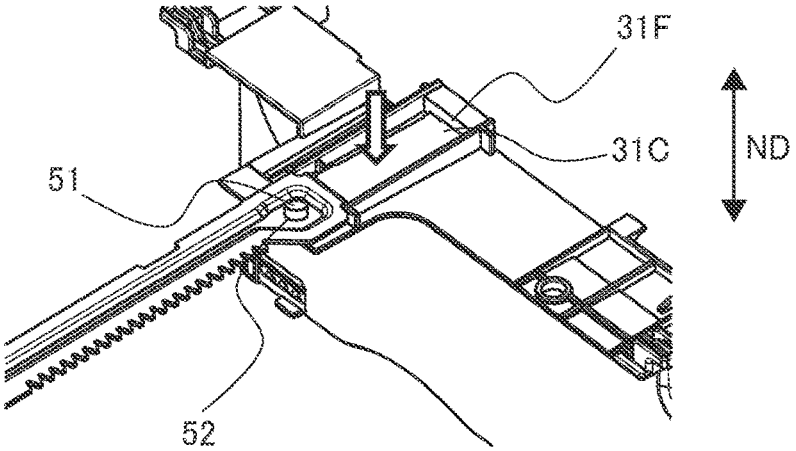
FIG. 12C is a perspective view showing a state where a boss portion has been engaged with a positioning hole.

Then, as shown in FIG. 12B, the worker inserts the tip portion 32C into the hole portion 31C while tilting a posture of the rack member 32 with respect to the regulation plate 231A so that the rack member 232 does not come into contact with the double-sided tape 50. Next, as shown in FIG. 12C, the worker rotates the rack member 232, and fits the bonding surface 37 of the rack member 232 on the bonding surface 36 of the regulation member 231A.

Since the pair of guide ribs 31G and 31G are formed on the regulation member 231A, by rotating the rack member 232 between the guide ribs 31G and 31G, it is possible to easily position the rack member 232. Further, since the guide ribs 31G and 31G divide the bonding surface 36 from other areas, it is possible to define a sticking position of the double-sided tape 50. Therefore, it is possible to improve assemblability.

Then, when the bonding surfaces 36 and 37 are fitted on each other, the boss portion 51 of the regulation member 231A is inserted into the positioning hole 52 of the rack member 232. Herewith, relative movements of the regulation member 231A and the rack member 232 in a shearing direction of the bonding surfaces 36 and 37, namely, in a direction parallel to the bonding surfaces 36 and 37 are regulated, and the regulation member 231A and the rack member 232 are positioned by each other. To be noted, the boss portion 51 constitutes the third engagement portion, and the positioning hole 52 constitutes the fourth engagement portion engaging with the third engagement portion. Further, similar assembling and positioning methods as described above are also applied to the side regulation plate 131.

Since the shear strength of the double-sided tape 50 is strong, as described in the first embodiment, even if a load is exerted on the regulation member 231A from the sheet P, the bonding of the bonding surfaces 36 and 37 is maintained, and it is possible to reduce a breakage of the regulation member 231A and the rack member 232. Further, since the bonding of the bonding surfaces 36 and 37 with the double-sided tape 50 is performed without fastening by a fastening member such as a screw and the like, and achieved at low cost without needing any special tools, it is possible to construct the side regulation plate 31 at low cost and high intensity.

In a state where the rack member 232 is fitted on the regulation member 231A, the relative movements of the regulation member 231A and the rack member 232 in the debonding direction of the bonding surfaces 36 and 37, namely, in the normal line direction ND of the bonding surfaces 36 and 37 are regulated by the regulation rib 31F. Therefore, it is possible to supplement the intensity of the double-sided tape 50 in the debonding direction (in the normal line direction ND), and possible to improve the accuracy of relative positions of the regulation member 231A and the rack member 232 in the normal line direction ND.

Further, since the double-sided tape 50 does not need such a hardening time that is needed for the adhesive 40 of the first embodiment, a curing time is not necessary. Further, since, in a case of faulty sticking, it is possible to peel off and stick again the double-sided tape 50, it is possible to improve the assemblability. Therefore, it is possible to assemble the regulation member 231A and the rack member 232 more easily, and possible to improve the assemblability along with reducing cost.

Shear Strength

Next, the shear strength of the double-sided tape 50 sticked on the bonding surfaces 36 and 37 in this embodiment will be described. The double-sided tape 50 used in this embodiment is, for example, #8616CH (trade name) manufactured by DIC Corporation, and the shear strength of the double-sided tape 50 is 0.09 kgf/mm$^2$. Therefore, so as to obtain the shear strength of 62 kgf calculated in the first embodiment, a bonding area of 689 mm$^2$ is required. Therefore, by enlarging the bonding area of the double-sided tape 50 as much as possible, it is possible to secure the margin for the shear strength.

Other Embodiments

While, in any of the embodiments described above, the sheet storage apparatus 60 includes the pair of side regulation plates movable in a direction approaching to or separating from each other, it is not limited to this. For example, it is acceptable to configure the sheet storage apparatus 60 in such a manner that one side of the side regulation plates is disposed non-movably and only the other side is disposed movably.

Further, while, in any of the embodiments described above, the side regulation plate is constructed by the regulation member regulating the position of the sheet in the moving direction MD and the rack member engaging with the pinion gear, it is not limited to this. For example, it is acceptable to apply a guide member, instead of the rack member, guiding the side regulation plate in the moving direction MD with respect to the cassette body 30. Regarding the guide member, it is not necessary to dispose a rack portion.

Further, while, in any of the embodiments described above, the bonding surfaces 36 and 37 are disposed parallel to the moving direction MD, it is not limited to this. For example, it is acceptable if the bonding surfaces 36 and 37 extend in a direction along the moving direction MD. In other words, it is acceptable if the bonding surfaces 36 and 37 extend in a direction having a component of the moving direction MD. Further, while the moving direction MD is a direction parallel to the attaching and detaching directions of the cassette 16, it is not limited to this.

Further, while, in any of the embodiments described above, the regulation members 31A and 231A are formed from resin material and the rack members 32 and 232 are formed from metal material, it is not limited to this. For example, it is acceptable that both of the regulation member and the rack member are formed from resin material, and that both of the regulation member and the rack member are formed from metal material.

Further, while, in the embodiments described above, the bonding surfaces 36 and 37 are bonded by the adhesive 40 or the double-sided tape 50, it is not limited to this. For example, it is acceptable to bond the bonding surfaces 36 and 37 by using both of the adhesive 40 and the double-sided tape 50. Further, it is acceptable to bond the bonding surfaces 36 and 37 by a method different from the adhesive 40 and the double-sided tape 50. For example, it is acceptable to bond the bonding surfaces 36 and 37 by welding and insert molding, and is acceptable if surfaces extending along the moving direction MD are bonded to each other by a method other than the fastening member such as the screw.

Further, while in the first embodiment, the relative movements of the regulation member 31A and the rack member 32 in the normal line direction ND are regulated by respectively engaging the hook portion 31D and the regulation rib 31F with the edge portion 32Da and the tip portion 32C, it is not limited to this. For example, it is acceptable that only either one of the engagements, namely, the engagement of the hook portion 31D and the edge portion 32Da and the engagement of the regulation rib 31F and the tip portion 32C is disposed, and acceptable that none of these two engagements is disposed. Further, shapes of these hook portion 31D, edge portion 32Da, and tip portion 32C are not limited.

Further, while in the first embodiment, the hook portion 31D and the regulation rib 31F are disposed in the regulation member 31A and the edge portion 32Da and the tip portion 32C are disposed in the rack member 32, it is not limited to this. For example, it is acceptable that the edge portion 32Da and the tip portion 32C are disposed in the regulation member 31A and the hook portion 31D and the regulation rib 31F are disposed in the rack member 32. That is, it is acceptable that the hook portion 31D and the regulation rib 31F are disposed in either one of the regulation member 31A and rack member 32, and the edge portion 32Da and the tip portion 32C are disposed in the other one of the regulation member 31A and the rack member 32.

Further, while in the first embodiment, the snap fit 31E is disposed in the regulation member 31A and the snap fit hole 32E is disposed in the rack member 32, it is not limited to this. For example, it is acceptable that the snap fit hole 32E is disposed in the regulation member 31A and the snap fit 31E is disposed in the rack member 32. That is, it is acceptable that the snap fit 31E is disposed in either one of the regulation member 31A and the rack member 32, and the snap fit hole 32E is disposed in the other one of the regulation member 31A and the rack member 32. Further, shapes of the snap fit 31E and the snap fit hole 32E are not limited.

Further, while in the second embodiment, the boss portion 51 is disposed in the regulation member 231A and the positioning hole 52 is disposed in the rack member 232, it is not limited to this. For example, it is acceptable that the positioning hole 52 is disposed in the regulation member 231A and the boss portion 51 is disposed in the rack member 232. That is, it is acceptable that the boss portion 51 is disposed in either one of the regulation member 231A and the rack member 232, and the positioning hole 52 is disposed in the other one of the regulation member 231A and the rack member 232. Further, shapes of the boss portion 51 and the positioning hole 52 are not limited. Further, it is acceptable to eliminate the boss portion 51 and the positioning hole 52.

Further, while, in any of the embodiments described above, the descriptions are provided using the printer 1 of the electrophotographic system, the present disclosure is not limited to this. For example, it is possible to apply the present disclosure to an image forming apparatus of an ink jet system which forms the image on the sheet by ejecting a liquid ink through a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-157201, filed Sep. 18, 2020 which is hereby incorporated by reference herein in its entirety.

What is claimed is:

1. A sheet storage apparatus attachable to an apparatus body in an attaching direction, the sheet storage apparatus comprising:

a sheet storage portion configured to store a plurality of sheets; and a moving unit movably supported by the sheet storage portion in a moving direction parallel to the attaching direction, and including:

a regulation member extending in the moving direction, and including:

a regulation surface regulating a position, in the moving direction, of the sheet stored in the sheet storage portion; and a first bonding surface extending along the moving direction; and an extending member extending in the moving direction, and including a second bonding surface extending parallel to the first bonding surface, wherein the first bonding surface faces the second bonding surface in a stacking direction in which the plurality of sheets are stacked in the sheet storage portion, and wherein the first bonding surface and the second bonding surface are bonded to each other with adhesive.

2. The sheet storage apparatus according to claim 1, further comprising a guided portion disposed in the sheet storage portion and configured to slide with respect to the apparatus body in a state where the sheet storage portion is attached to the apparatus body in the attaching direction, the guided portion extending in the attaching direction.

3. The sheet storage apparatus according to claim 1, wherein the first bonding surface and the second bonding surface extend parallel to the moving direction.

4. The sheet storage apparatus according to claim 1, wherein:

one of the regulation member or the extending member includes a first engagement portion, and the other of the regulation member or the extending member includes a second engagement portion configured to regulate positions of the regulation member and the extending member in a normal line direction of the first bonding surface and the second bonding surface by engaging with the first engagement portion.

5. The sheet storage apparatus according to claim 4, wherein:

one of the regulation member or the extending member includes a third engagement portion, and the other of the regulation member or the extending member includes a fourth engagement portion configured to regulate positions of the regulation member and the extending member in a direction parallel to the first bonding surface and the second bonding surface by engaging with the third engagement portion.

6. The sheet storage apparatus according to claim 1, wherein:

the regulation member includes:

a first wall portion extending along the moving direction;

a second wall portion extending along the moving direction; and a third wall portion extending along a direction orthogonal to the moving direction and connecting the first wall portion to the second wall portion, and the first wall portion, the second wall portion, and the third wall portion surround the first bonding surface.

7. The sheet storage apparatus according to claim 1, wherein:

the regulation member is made from resin material, and the extending member is made from metal material.

8. The sheet storage apparatus according to claim 1, wherein:

the moving unit, the regulation member, and the extending member are respectively a first moving unit, a first regulation member, and a first extending member, the sheet storage apparatus further comprises:

a second moving unit configured to be movably supported by the sheet storage portion in the moving direction; and a gear member configured to be rotatably supported by the sheet storage portion, the second moving unit comprises a second regulation member configured to regulate the position, in the moving direction, of the sheet stored in the sheet storage portion, and a second extending member extending in the moving direction, and the first extending member and the second extending member each comprise a rack portion engaging with the gear member.

9. An image forming apparatus comprising:

the sheet storage apparatus according to claim 1; and an image forming unit disposed in the apparatus body and configured to form an image on the sheet.

10. The image forming apparatus according to claim 9, wherein the apparatus body comprises a sheet feeding unit configured to feed the sheet stored in the sheet storage apparatus in a direction orthogonal to the moving direction.

11. A sheet storage apparatus attached to an apparatus body in an attaching direction, the sheet storage apparatus comprising:

a sheet storage portion configured to store a plurality of sheets; and a moving unit movably supported by the sheet storage portion in a moving direction parallel to the attaching direction, and including:

a regulation member extending in the moving direction, and including:

a regulation surface regulating a position, in the moving direction, of the sheet stored in the sheet storage portion; and a first bonding surface extending along the moving direction; and an extending member extending in the moving direction, and including a second bonding surface extending parallel to the first bonding surface, wherein the first bonding surface faces the second bonding surface in a stacking direction in which the plurality of sheets are stacked in the sheet storage portion, and wherein the first bonding surface and the second bonding surface are configured to be bonded to each other by double-sided tape.

12. The sheet storage apparatus according to claim 11, further comprising a guided portion disposed in the sheet storage portion and configured to slide with respect to the apparatus body in a state where the sheet storage portion is attached to the apparatus body in the attaching direction, the guided portion extending in the attaching direction.

13. The sheet storage apparatus according to claim 11, wherein the first bonding surface and the second bonding surface extend parallel to the moving direction.

14. The sheet storage apparatus according to claim 11, wherein:

one of the regulation member or the extending member includes a first engagement portion, and the other of the regulation member or the extending member comprises a second engagement portion configured to regulate positions of the regulation member and the extending member in a normal line direction of the first bonding surface and the second bonding surface by engaging with the first engagement portion.

15. The sheet storage apparatus according to claim 14, wherein:

one of the regulation member or the extending member includes a third engagement portion, and the other of the regulation member or the extending member includes a fourth engagement portion configured to regulate positions of the regulation member and the extending member in a direction parallel to the first bonding surface and the second bonding surface by engaging with the third engagement portion.

16. The sheet storage apparatus according to claim 11, wherein:

the regulation member includes:

a first wall extending along the moving direction;

a second wall portion extending along the moving direction; and a third wall portion extending along a direction orthogonal to the moving direction and connecting the first wall portion to the second wall portion, and the first wall portion, the second wall portion, and the third wall portion surround the first bonding surface.

17. An image forming apparatus comprising:

the sheet storage apparatus according to claim 11; and an image forming unit disposed in the apparatus body and configured to form an image on the sheet.

18. The image forming apparatus according to claim 17, wherein the apparatus body comprises a sheet feeding unit configured to feed the sheet stored in the sheet storage apparatus in a direction orthogonal to the moving direction.

* * * * *